US007377381B2

(12) United States Patent
Dziaba et al.

(10) Patent No.: US 7,377,381 B2
(45) Date of Patent: May 27, 2008

(54) BEVERAGE HOLDER ADAPTERS FOR NON-CYLINDRICAL, MULTI-SIDED FOOD CONTAINERS

(75) Inventors: Michele M. Dziaba, Mundelein, IL (US); James McCay, Fairfield, CT (US)

(73) Assignee: Kraft Foods Holdings, Inc., Northfield, IL (US)

( * ) Notice: Subject to any disclaimer, the term of this patent is extended or adjusted under 35 U.S.C. 154(b) by 359 days.

(21) Appl. No.: 11/028,601

(22) Filed: Jan. 5, 2005

(65) Prior Publication Data

US 2006/0144750 A1 Jul. 6, 2006

(51) Int. Cl.
*B65D 5/52* (2006.01)

(52) U.S. Cl. ..... 206/45.24; 206/549; 426/120

(58) Field of Classification Search ..... 206/45.2, 206/45.21, 45.24, 45.25, 216, 217, 223, 527, 206/541, 549, 501, 557, 560; 229/905, 906; 248/309.1, 311.2, 146, 165, 166, 346.01, 248/688; 426/85, 86, 112, 115, 120, 124
See application file for complete search history.

(56) References Cited

U.S. PATENT DOCUMENTS 1,699,875 A * 1/1929 Burgess ..... 248/152
5,052,649 A 10/1991 Hunnicutt
5,088,673 A 2/1992 Chandler
5,174,534 A 12/1992 Mitchell
5,351,928 A * 10/1994 Cooper et al. ..... 248/459
5,490,653 A 2/1996 Ingwersen
5,601,268 A 2/1997 Dunchock
D381,264 S 7/1997 Lippincott
5,676,340 A 10/1997 Ruhnau
6,109,580 A 8/2000 Stern et al.
6,113,049 A 9/2000 Miljanich
D432,409 S 10/2000 Feldmeier
D443,510 S 6/2001 Doucette
D446,719 S 8/2001 Garraway
D458,084 S 6/2002 Hudson
D469,310 S 1/2003 Bukowski
D471,766 S 3/2003 Bradley et al.
6,568,543 B1 * 5/2003 Schneider ..... 211/43
6,929,117 B1 * 8/2005 Cohen ..... 206/45.25
D536,615 S 2/2007 Dziaba et al.
D538,655 S 3/2007 Dziaba et al.
2001/0032791 A1 10/2001 Hudson
2002/0023992 A1 2/2002 Veltri et al.
2002/0043603 A1 4/2002 Thomas
2002/0108880 A1 * 8/2002 Krupa et al. ..... 206/223
2002/0185578 A1 12/2002 Hudson
2003/0141424 A1 7/2003 Thomas

* cited by examiner

*Primary Examiner*—Luan K Bui
(74) *Attorney, Agent, or Firm*—Fitch, Even, Tabin & Flannery

(57) ABSTRACT

Adapters are provided for stable holding of non-cylindrical multi-sided food containers in beverage container receptacles, and also packaged food products integrating such adapters, and container support systems including beverage receptacles and the packaged food products held in the beverage receptacles via the adapters.

14 Claims, 6 Drawing Sheets

FIG. 8
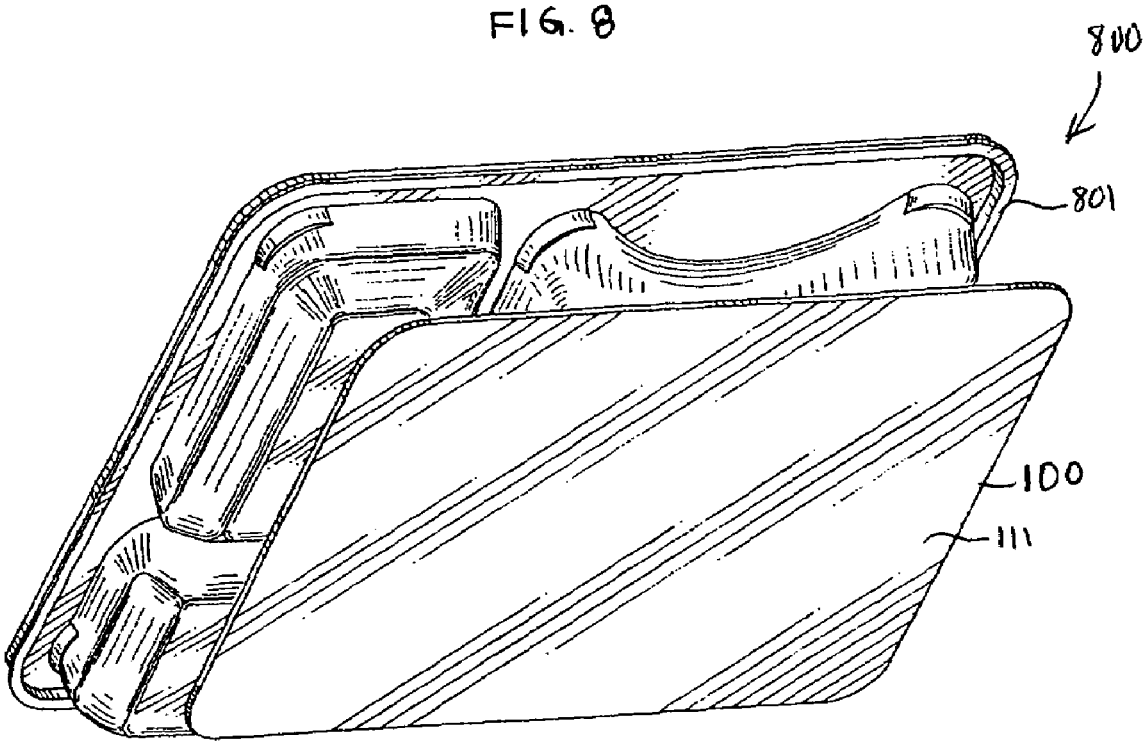
FIG. 9
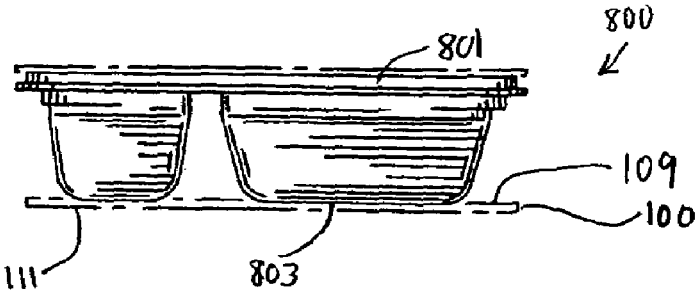
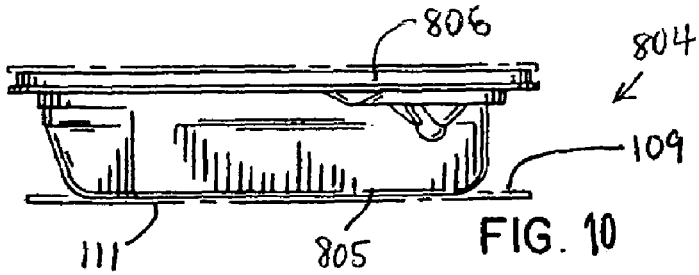
FIG. 10

BEVERAGE HOLDER ADAPTERS FOR NON-CYLINDRICAL, MULTI-SIDED FOOD CONTAINERS

FIELD OF THE INVENTION

The invention generally relates to adapters for holding food containers in beverage container receptacles, especially non-cylindrical, multi-sided food containers, and also relates to packaged food products and food container support systems integrating such adapters.

BACKGROUND OF THE INVENTION

Many vehicles such as automobiles, vans, buses, boats, aircraft, and recreational vehicles, as well as stationary seating venues, such as in stadiums, arenas, theaters, lawn furniture, home leisure chairs, tables, and so forth, have built-in receptacles sized for receipt and holding of beverage containers.

Typical beverage holders of the prior art are configured to support cylindrical-shaped beverage containers. However, in addition to beverage containers, consumers also often desire to transport packaged food items which can be eaten directly from containers by hand without the need for serving plates/bowls and eating utensils, e.g., Kraft LUNCHABLES® ready-to-eat meals and snacks. Also, for example, many convenience restaurants and stores sell fried or baked chicken pieces or nachos, etc., which are packaged in a small hinged carton, or a tray having a removable cover. These food cartons and trays often have a rectangular shaped bottom profile. Such trays and cartons generally do not have a size and/or shape allowing them to nest in a typical beverage container holder.

SUMMARY OF THE INVENTION

The invention provides an adapter for stably supporting a food container such as a non-cylindrical multi-sided food container or tray over a beverage container receptacle defining a cylindrical shape-supporting cavity. The adapter has a flat first part attached to a bottom of the food container and a second part foldable into a self-supporting pedestal structure configured to project away from the first part operable to be seated in the cylindrical shape-supporting cavity and restrict lateral movement of the food container relative to the beverage receptacle.

In some embodiments, the adapter comprises a unitary paperboard member which can be manipulated from a two dimensional format into a three dimensional structure which can be fitted snugly into a cylindrical shape-supporting beverage cup holder to stabilize a tray attached upon the adapter in order to minimize food spillage. The adapter enables stable support and hands-free holding of food containers in existing beverage holders installed on-board vehicles, or in chairs, tables, locations adjacent to audience or spectator seats, or other locations.

In some embodiments, the adapter comprises a unitary paperboard member having fold lines allowing portions of the paperboard member to be folded into the pedestal structure while other portions thereof remain attachable to a bottom side of a food container. In one embodiment, the adapter, in an unfolded state, comprises a generally planar structure having a polygonal peripheral shape, and preferably a generally rectangular shape.

In a particular embodiment, the adapter comprises a unitary paperboard member having a generally flat first part having a first side attached to a bottom side of a non-cylindrical multi-sided food container or tray and an opposite second side. The adapter also has a second part including first and second flap portions adapted to be folded out of their original flat orientation into upright positions projecting away from the first part. The first flap portion preferably is connected to the first part via a fold line provided in the paperboard such that the first flap portion is adapted to be foldable from an orientation generally coplanar with the first part into a downwardly-extending position oriented substantially perpendicular to the first part. The second flap portion preferably has an arch-like structure comprising first and second arms merging with the first part at respective fold lines and an integral bridge portion connects the arms. The second flap portion is adapted to be folded from an orientation generally coplanar with the first part to a folded position located over the first flap portion in sliding engagement therewith such that the second flap portion is foldable into a downwardly-extending position wherein its arms are oriented substantially perpendicular to the first part and its bridge portion is oriented substantially perpendicular to the folded first flap portion. The folded first and second flap portions thereby are adapted to form a self-supporting pedestal structure configured to project away from the second side of the first part and operable to be seated in the cylindrical shape-supporting cavity and restrict lateral movement of the food container relative to the receptacle.

In another particular embodiment, the adapter comprises a folded paperboard blank having a shared side edge comprising a first fold line connecting a generally polygonal first paperboard layer superposed on a generally polygonal second paperboard layer. The first and second paperboard layers having a nonfoldable first part and a foldable second part, wherein portions of the first and second paperboard layer comprising the foldable second part are adapted to fold into a self-supporting pedestal structure configured to project away from nonfoldable first part and operable to be seated in the cylindrical shape-supporting cavity and restrict lateral movement of the food container relative to the receptacle.

In a further embodiment, packaged food products are provided which integrate a food container containing a food product with the indicated adapter attached to the bottom side of the food container. Food container support systems are also provided in which the packaged food products are held in beverage receptacles via the adapter, which forms a self-supporting pedestal structure configured to project away from the food container and be operable to be releasably seated in the cylindrical shape-supporting cavity of a beverage receptacle to restrict movement of the food container relative to the receptacle and thus stabilize the food container in position over the receptacle.

BRIEF DESCRIPTION OF THE FIGURES

Other features and advantages of the invention will become apparent from the following detailed description of preferred embodiments of the invention with reference to the drawings, in which:

FIG. 8 is a bottom perspective view of a packaged food product including a food tray and the adapter of FIGS. 1-3 in accordance with an embodiment of this invention.

FIG. 9 is a side elevational view of the packaged food product of FIG. 8.

FIG. 10 is a side elevational view of an alternative packaged food product including a single well food tray and the adapter of FIGS. 1-3 in accordance with another embodiment of this invention.

The features depicted in the figures are not necessarily drawn to scale. Similarly numbered elements in different figures represent similar components unless indicated otherwise.

DESCRIPTION OF THE PREFERRED EMBODIMENTS

Preferred embodiments of the invention will be described below with specific reference to an adapter convenient for holding non-cylindrical, multi-sided food containers in existing beverage container holders installed aboard vehicles or adjacent spectator/audience seating or leisure chairs or tables, and so forth, as well as packaged food products which integrate the cup adapter with a food container. Among other advantages, the adapter enables foods served in non-cylindrical, multi-sided containers to be stably held for consumption in existing beverage holders in an "on-the-go" manner in moving vehicles, or, alternatively, at public arenas or theaters and the like so that the consumer may enjoy the event while eating the food from the container in a hands-free manner.

Figure 1:
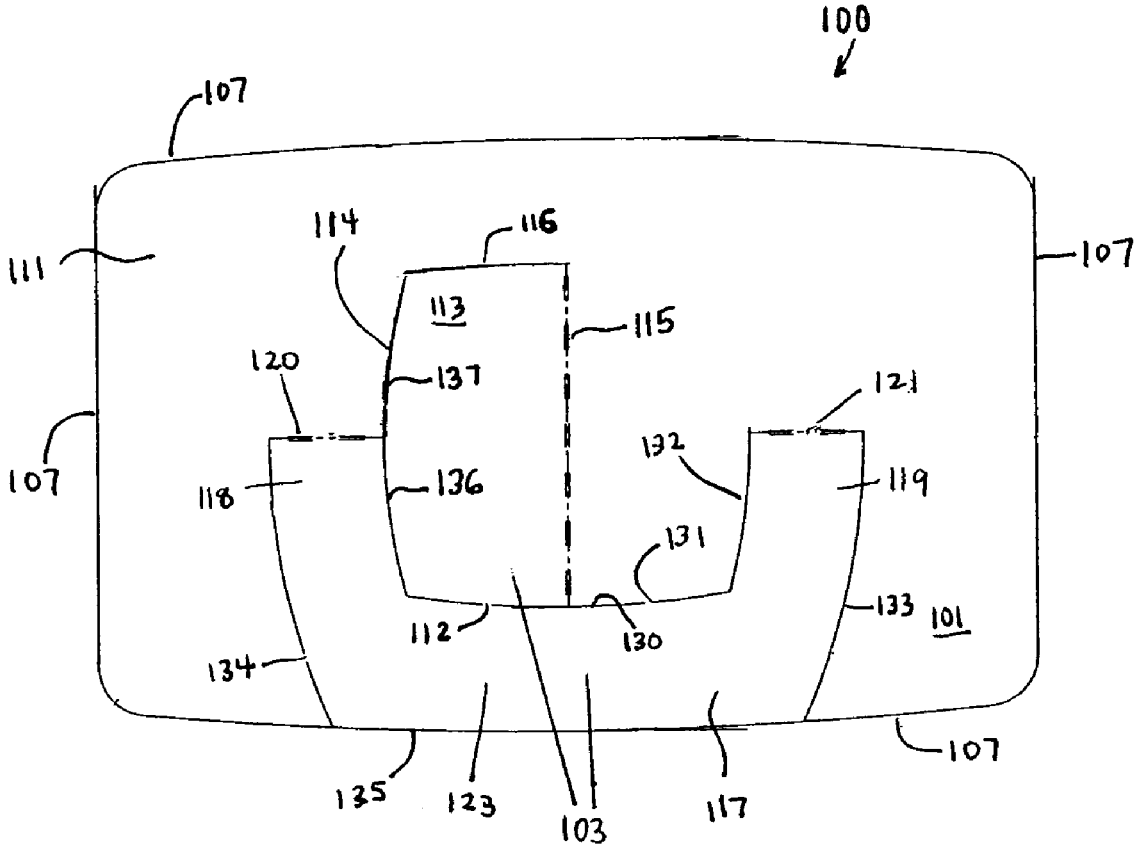
FIG. 1 shows an adapter in its blank configuration in accordance with an embodiment of this invention.
Figure 2:
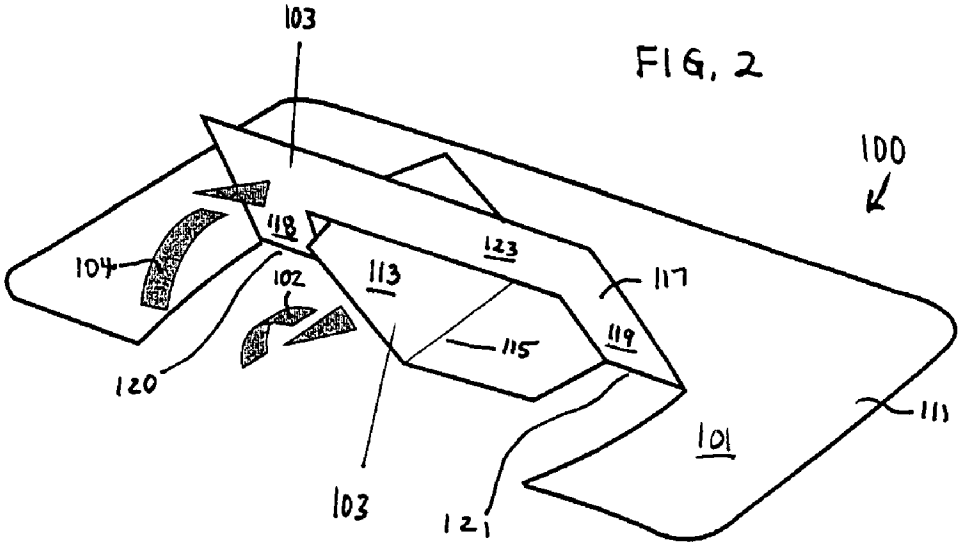
FIG. 2 shows a partly deployed adapter of FIG. 1 in accordance with an embodiment of this invention.
Figure 3:
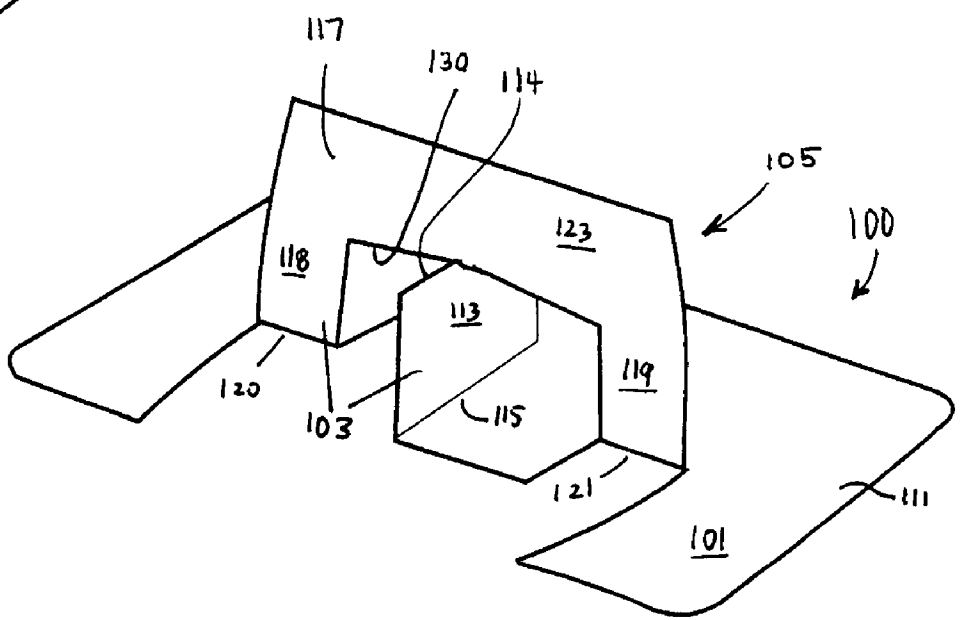
FIG. 3 shows a fully deployed adapter of FIG. 1 in accordance with an embodiment of this invention.

Referring to FIGS. 1-3, an adapter 100 for supporting a non-cylindrical, multi-sided food container over a beverage container receptacle according to one preferred embodiment is shown. The adapter 100 comprises a first flat part 101 attachable (via its opposite side hidden in these views) to a bottom of a food container and a second part 103 foldable into a self-supporting pedestal structure 105. As shown, the second part 103 is a two-piece construction. As discussed in greater detail below with reference to FIGS. 9-10, the pedestal structure 105 is configured to project away from the first part 101 and is operable to be seated in the cylindrical shape-supporting cavity of a beverage container receptacle and restrict lateral movement of a food container attached thereto relative to the receptacle.

Referring to FIG. 1, the adapter 100 starts, in an unfolded state, as a generally planar structure having a polygonal peripheral shape 107, such as a generally planar structure having a generally rectangular shape. The adapter 100 can be made as a flexible yet self-supporting unitary paperboard member, such as a discrete piece of monolayer paperboard. The adapter 100 comprises a generally flat first part 101 having a first side 109 (best seen in FIGS. 9-10) attachable to a bottom side of a non-cylindrical multi-sided food container or tray and an opposite second side 111 (seen in this view). In one embodiment, the adapter 100 also may be used as a backcard attached to the bottom of a food container or tray wherein nutritional/ingredient labeling is provided on exposed side 111 of adapter 100.

The second part 103 of adapter 100 includes a first flap portion 113 connected to the first part 101 via a fold line 115 provided in the common paperboard blank. This fold, and also other fold lines referred to herein, refer to lines of weakness formed in the paperboard relative to immediately adjoining regions of the paperboard. The lines of weakness can be formed by scoring, intermittent perforating, creasing, and so forth, in manners generally known in the paperboard folding arts. The first flap portion 113 has three sides defined by cut lines 112, 114, 116 (i.e., cut through the entire thickness of the paperboard blank) which allow the flap portion 113 to be folded at fold line 115 in a hinged manner. It will be noted that cut line 114 includes cut line segments 136 and 137.

As can be seen from the succession of views in FIGS. 1-3, the first flap portion 113 is adapted to be foldable from an orientation generally coplanar with the first part 101 into a downwardly-extending position oriented substantially perpendicular to the first part 101. The direction of folding is indicated by arrow 102 in FIG. 2, showing an intermediate assembly of the pedestal structure 105.

The second part 103 also includes a second flap portion 117 having an arch-shaped structure comprising first and second arms 118 and 119 merging with the first part 101 at respective fold lines 120 and 121 and a bridge portion 123 connecting the arms 118 and 119. The second flap portion 117 has sides defined by cut lines 130, 132, 133, 134, and 136 (i.e., cut through the entire thickness of the paperboard blank), and a free edge or side 135 of the blank, which allow the flap portion 117 to be folded at fold lines 120 and 121 in a hinged manner and in the direction of folding indicated by arrow 104. It will be noted that cut line 130 is a combination of cut line segments 112 and 131.

As can be seen in FIGS. 1-3, the second flap portion 117 is adapted to be folded from an orientation generally coplanar with the first part 101 to a folded position located over the first flap portion 113 in sliding engagement therewith such that the second flap portion 117 is foldable into a downwardly-extending position wherein its arms 118 and 119 are oriented substantially perpendicular to the first part 101, and its bridge portion 123 is oriented substantially perpendicular to the folded first portion 113. The cut line 130 forms a bottom edge of the bridge portion 123 which slidably engages the cut line 114 forming an upper edge of first flap portion 113 such that the first and second flap portions 113 and 103 can be temporarily physically engaged into a self-supporting pedestal structure 105. The folded first and second flap portions 113 and 117 are adapted to form a self-supporting pedestal structure 105 configured to project away from the second side of the first part 101 and operable to be seated in the cylindrical shape-supporting cavity and restrict lateral movement of a food container relative to the receptacle.

Referring to FIGS. 4-7, an adapter 201 for supporting a non-cylindrical, multi-sided food container over a beverage container receptacle according to another preferred embodiment is shown.

Figure 4:
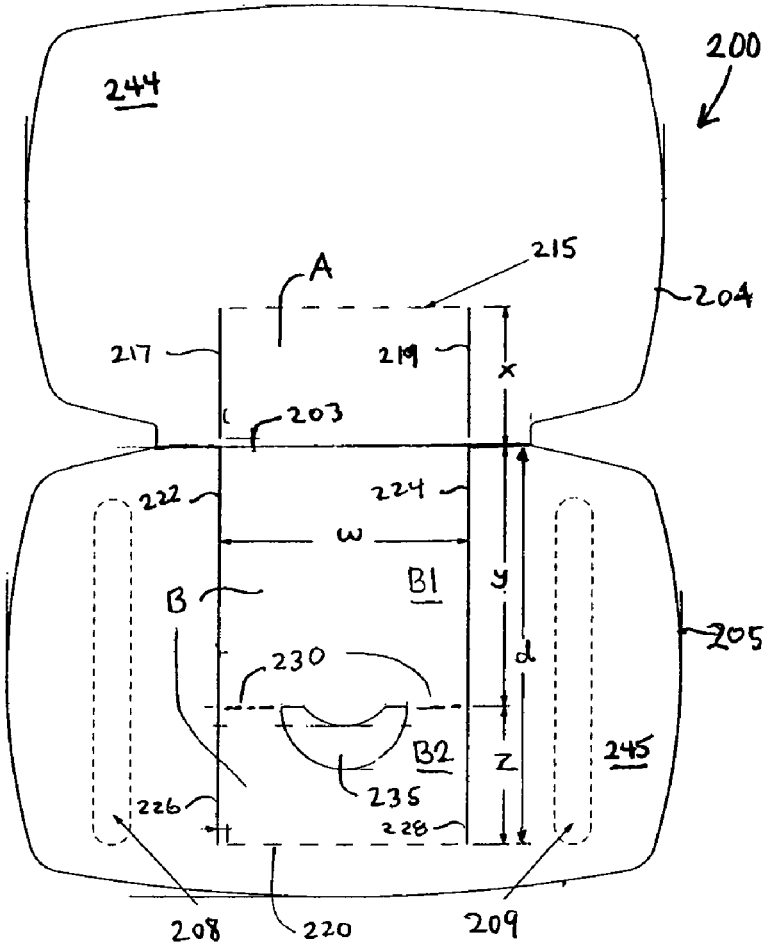
FIG. 4 shows an adapter in a preliminary blank configuration in accordance with another embodiment of this invention.

Referring to FIG. 4, in one embodiment, the adapter is constructed starting with an unfolded paperboard blank 200. The blank 200 has a generally planar structure comprises a polygonal first paperboard layer 204 and a generally polygonal second paperboard layer 205 interconnected near an intervening fold line 203. The paperboard layer 204 has a first exposed side 244 and an opposite side (hidden in this view). The paperboard layer 205 has a first exposed side 245 and an opposite side (hidden in this view).

Figure 5:
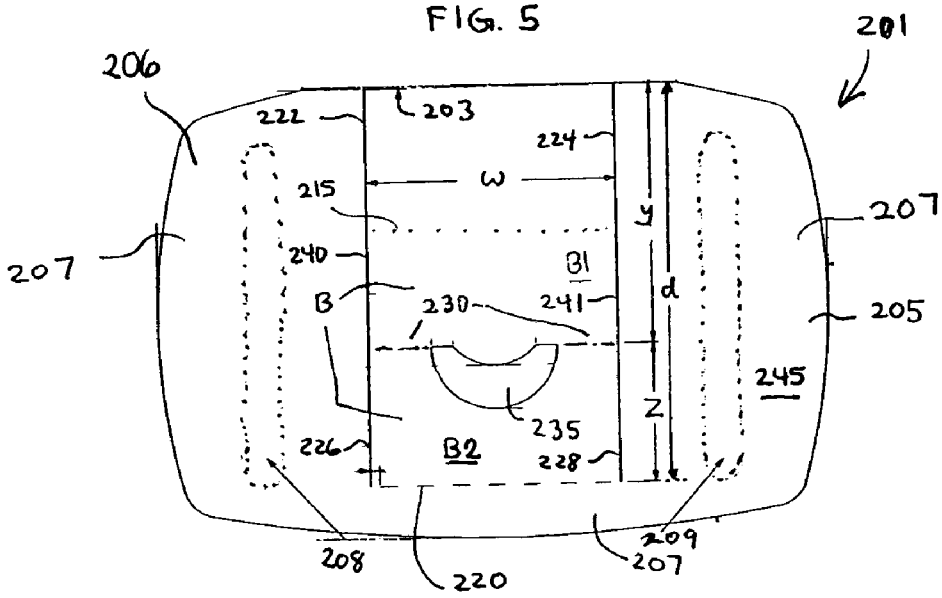
FIG. 5 shows the adapter of FIG. 4 in its ready-for-use doubled-over configuration.

Referring to FIG. 5, the adapter 201 has been formed by folding the paperboard blank 200 of FIG. 4 in half along the shared fold line 203. In the perspective of FIG. 5, paperboard layer 204 is folded beneath paperboard layer 205 in the folded structure of this illustration. Fold line 203 physically connects the generally polygonal first paperboard layer 204 superposed on the generally polygonal second paperboard layer 205. Referring to FIG. 5, the adapter blank 200 has been folded into an intermediate structure 206 such that side 245 of layer 205 and side 244 of layer 204 (hidden in this view) form the outer exposed sides of the adapter 201 at this juncture.

When superposed in this manner, the first and second paperboard layers 204 and 205 have a nonfoldable first part 207 and foldable second part 210. The nonfoldable first part 207 can be joined, for example, by adhesion, such as by applying adhesive 208 and 209 to layer 204 and/or 205 (e.g., on the bottom (hidden) face(s) thereof opposite to sides 244 and/or 245 of blank 200 at locations such as indicated by the dashed lines in the perspective of FIGS. 4-5) before the layers 204 and 205 are doubled over on one another effective to sandwich the adhesive therebetween. After being arranged in this manner, the adapter 201 is ready to be attached to the bottom side of a container and used in manners described in greater detail hereinafter.

Referring to FIGS. 4 and 5, the foldable second part 210 of the adapter 201 is comprised in part by portion A of paperboard layer 204 which is defined by fold line 215 and cut lines 217 and 219, and the remainder of foldable second part 210 is comprised by portion B located in paperboard layer 205 which is contiguous with portion A via shared fold line 203. Portion B is defined by fold line 220 and cut lines 222, 226, 224 and 228. Portion B has two regions: regions B1 and B2 which are separated by additional fold line 230 and a cutout 235. Cut lines 222 and 226 are generally parallel to cut lines 224 and 228, respectively. Cut lines 222 and 226, and also cut lines 224 and 228, preferably can be formed as single continuous cut line 240 (or cut line 241, as applicable).

In FIG. 5, the location of the fold line 215 of the first paperboard layer 204 (which is hidden in this view as layer 204 underlies layer 205 in this perspective) in the adapter 201 is indicated by phantom lines. The portions A and B together comprise the foldable second part 210 of the adapter 201.

In a particular embodiment, the foldable second part 210 comprises the fold line 215 in the first paperboard layer 204 generally parallel to and separated by an intervening distance x from the shared fold line 203, and parallel cut lines 217 and 219 extend generally perpendicularly between the fold lines 215 and 203, to define a first foldable portion A of the foldable second part 210. A fold line 230 is provided in the second paperboard layer 205 generally parallel to and separated by an intervening second distance y from the shared fold line 203, and parallel cut lines 222 and 224 extend generally perpendicularly between the fold lines 230 and 203, to define a base portion B1 of the foldable second part 210. The magnitude of distance y is greater than the distance x. An additional fold line 220 is provided in the second paperboard layer 205 generally parallel to and separated by an intervening distance d from the shared fold line 203, parallel cut lines 226 and 228 extend generally perpendicularly between fold lines 220 and 230, and wherein the distance d is greater than the distance y, to define a second foldable portion B2 of the foldable second part 210 which is located between fold lines 220 and 230. The fold lines 220 and 230 are separated by an intervening distance z which is the same or approximately the same as distance x.

This construction allows the first foldable portion A and second foldable portion B2 to be foldable to substantially upright positions relative to the unfolded first part 207 of the adapter, such that first and second foldable portions A and B2, and the intervening base portion B1, form a self-supporting pedestal structure 250 configured to project away from the nonfoldable first part 207 of adapter 201. The adapter 201 preferably includes a cutout 235 in the foldable portion B which is operable to facilitate manual lifting or pulling of the foldable second part 210 away from the nonfoldable first part 207.

Figure 6:
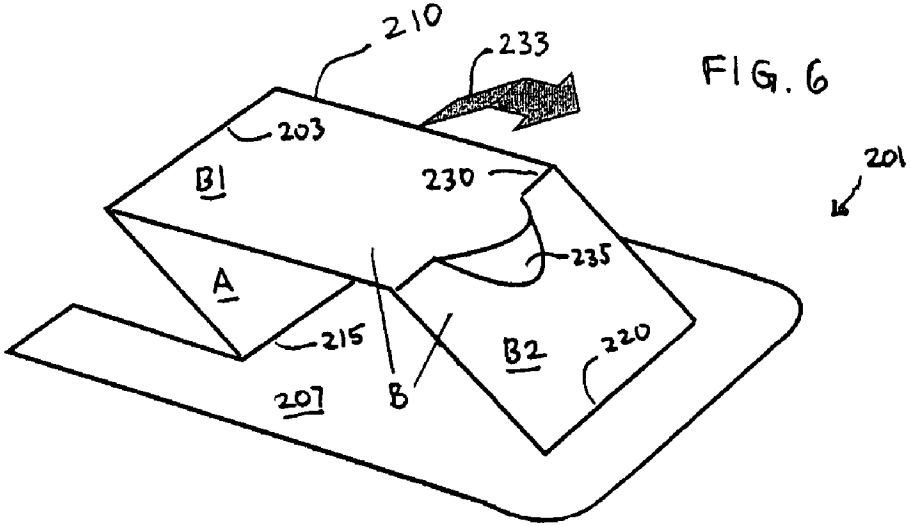
FIG. 6 shows a partly deployed adapter of FIG. 5 in accordance with an embodiment of this invention.
Figure 7:
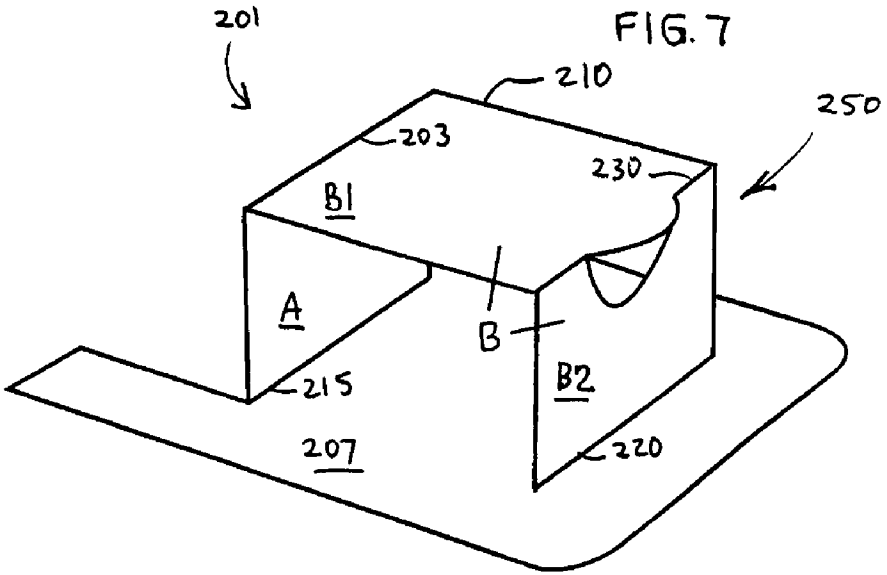
FIG. 7 shows a fully deployed adapter of FIG. 5 in accordance with an embodiment of this invention.

Referring to FIGS. 6-7, foldable second part 210 of adapter 201 (i.e., combined portions A and B (B1 and B2)) is adapted to be folded into a self-supporting pedestal structure 250 configured to project away from the nonfoldable first part 207 (see FIGS. 6-7). FIG. 6 shows an intermediate, partly deployed foldable part 210, and the direction of displacement during folding of the foldable part 210 is indicated by the arrow 233. FIG. 7 shows the fully deployed foldable part 210. In this manner, the adapter 201 is operable to be seated in the cylindrical shape-supporting cavity and restrict lateral movement of the food container relative to the receptacle, as will become more apparent from the following descriptions.

Referring to FIG. 8, a packaged food product 800 is shown comprising non-cylindrical, multi-sided food container or tray 801 containing a food product (not shown), and adapter 100. It will be appreciated that the adapter used in this embodiment also could be adapter 201 described above. FIG. 9 is a side elevational view showing the upper side 109 of adapter 100 which is integrally attached to the bottom side 803 of food container 801 to form the unitary packaged food product 800. Side 111 of the adaptor 100 is exposed and available for deployment of the adaptor into the folded configuration. The adapter 100 can be attached at its side 109 to the bottom side 803 of the food container 801 in any convenient manner, such as via adhesive bonding. Alternatively, if adapter 201 is used, it can be attached at its side 244 to the bottom side 803 of the food container 801 in any convenient manner, while its side 245 is left exposed and available for deployment of the adaptor 201 into the folded configuration. In the illustrations of FIGS. 8-9, the food container 801 is a non-cylindrical, multi-sided and multi-welled food container or tray.

In an alternative arrangement shown in FIG. 10, a packaged food product 804 may be comprised of a non-cylindrical, multi-sided and single-welled food container or tray 806, and the upper side 109 of adapter 100 (or side 244 of adaptor 201) is attached to the bottom side 805 of food container 806 to form the unitary packaged food product 804. In the illustration of FIG. 10, the food container 806 is a non-cylindrical, multi-sided and single-welled food container or tray. The food container of FIG. 10 has a polygonal bottom side, and particularly a generally rectangular bottom side.

Figure 11:
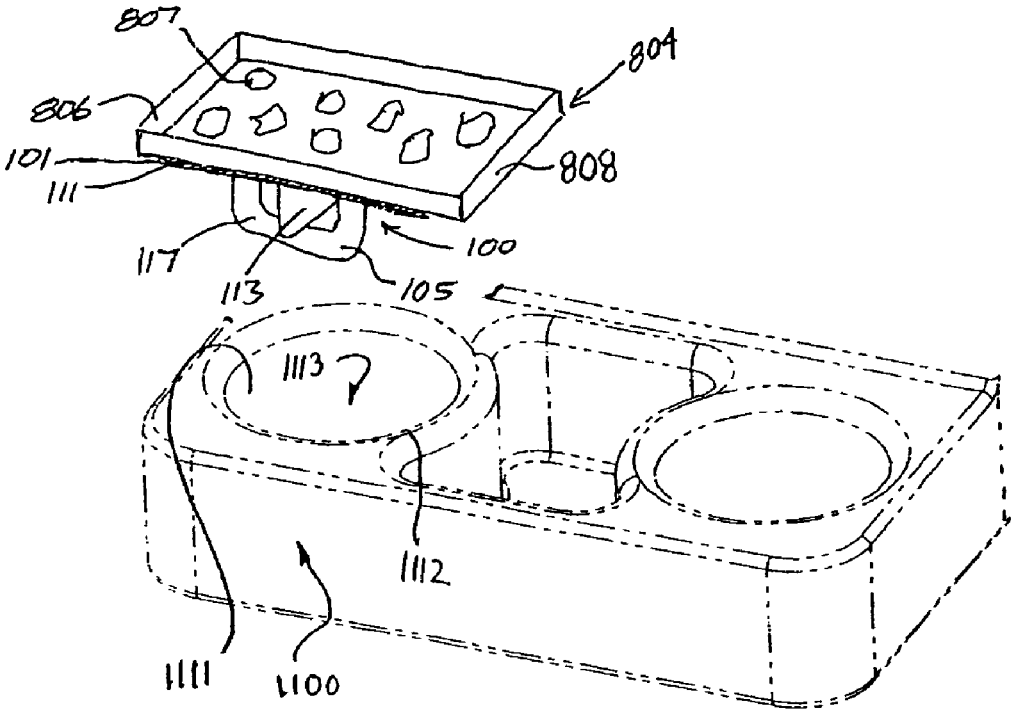
FIG. 11 is a top front perspective exploded view of the packaged food product of FIG. 10 suspended above a beverage container holder.

Referring to FIG. 11, the packaged food product 804 of FIG. 10 is illustrated as suspended above a beverage container holder 1100 having a generally planar support surface 1111 having at least one receptacle 1111 disposed therein which is defined by a cylindrical shaped sidewall 1112 defining a cavity 1113 having cylindrical or substantially cylindrical cross-section and a predetermined cavity diameter and depth.

In this illustration, the packaged food product 804 contains food pieces 807. The food product 807 is not particularly limited, and may be, for example, cooked meat pieces (e.g., fried chicken pieces), vegetable pieces, fruit pieces, nachos, cheese, crackers, lunchmeat, confections, and combinations thereof.

The adapter 100 includes a flat first part 101 attached to a bottom of a food container 806 and a second part comprising foldable portions 113 and 117 which fold into a self-supporting pedestal structure 105 configured to project away from the first part 101, as previously discussed. In this non-limiting illustration, the food container 806 has a rectangular-shaped tray portion 808 in which the food product 807 has been placed. The tray portion 808 of food container 806 also could have other shapes, such as, for instance, square, hexagonal, circular, oval, etc. The pedestal structure 105 of adapter 100 is configured for insertion into receptacle 1111 of the beverage container holder 1100, which can be a typical or conventional beverage container holder, thereby providing lateral stability to packaged food product 804. The adapter 100 also allows the food container 806 to be releasably held in a stable position within the beverage holder or receptacle 1111.

Figure 12:
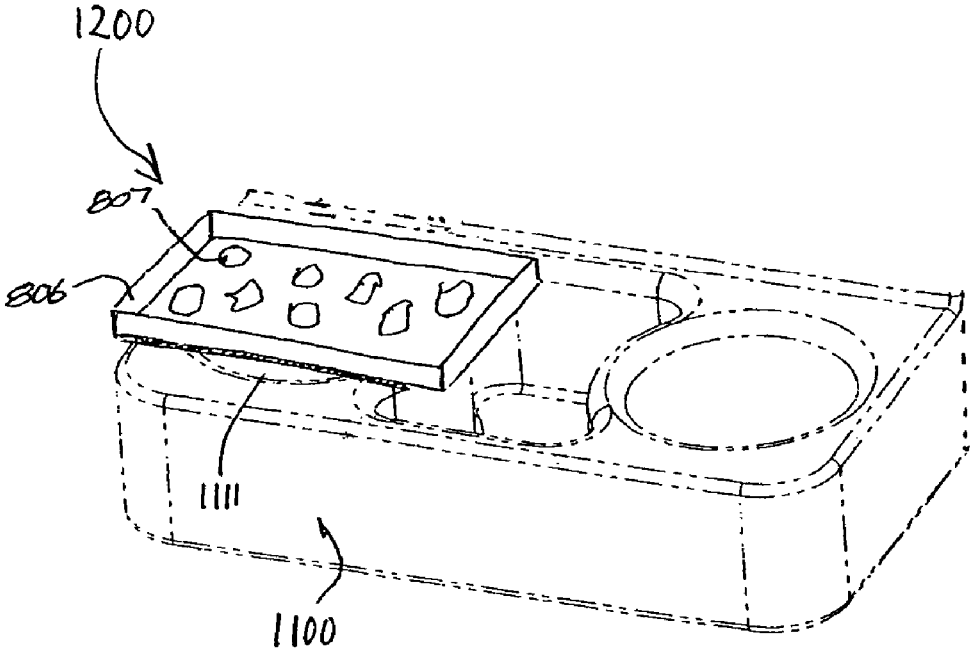
FIG. 12 is a top front perspective view of the packaged food product of FIG. 10 inserted in a beverage receptacle of the beverage container holder of FIG. 11, providing, in combination, a food container support system.

Referring to FIG. 12, a food container support system 1200 is provided in which the pedestal structure 105 of the adapter 100 of packaged food product 806 has been inserted into cylindrical shape-supporting beverage container receptacle 1111 effective to securely hold and stabilize the non-cylindrical, multi-sided tray 806.

Cylindrical shape-supporting beverage holders and receptacles which can be adapted to support non-cylindrical, multi-sided containers or trays in accordance with embodiments herein include, e.g., those are commonly installed in vehicles, leisure chairs, and adjacent audience or spectator seats in various venues to hold a consumer's beverage cup, can, glass, bottle, etc.

While the invention has been particularly described with specific reference to particular process and product embodiments, it will be appreciated that various alterations, modifications and adaptations may be based on the present disclosure, and are intended to be within the spirit and scope of the invention as defined by the following claims.

What is claimed is:

1. A packaged food product comprising:

a non-cylindrical, multi-sided food container containing a food product; and an adapter attached to a bottom side of the food container, the adapter comprising a flat first part attachable to a bottom of a food container and a second part foldable into a self-supporting pedestal structure configured to project away from the first part and being operable to be seated in a cylindrical shape-supporting cavity of a beverage container receptacle and restrict lateral movement of a food container attached thereto relative to the receptacle.

2. The packaged food product of claim 1, wherein the food container has a polygonal bottom side.

3. The packaged food product of claim 1, wherein the food container has a generally rectangular bottom side.

4. The packaged food product of claim 1, wherein the food product is selected from the group consisting of cooked meat pieces, vegetable pieces, fruit pieces, nachos, cheese, crackers, lunchmeat, confections, and combinations thereof.

5. The packaged food product of claim 1, wherein the adapter, as unfolded, comprises a generally planar structure having a polygonal peripheral shape.

6. The packaged food product of claim 1, wherein the adapter comprises a unitary paperboard member.

7. The packaged food product of claim 1, wherein the flat first part comprises:

a first side attachable to a bottom side of a non-cylindrical multi-sided container or tray and an opposite second side.

8. The packaged food product of claim 1, wherein the adapter comprises:

a folded paperboard blank having a shared side edge comprising a first fold line connecting a generally polygonal first paperboard layer superposed on a generally polygonal second paperboard layer, said first and second paperboard layers comprising a nonfoldable first part and a foldable second part, wherein portions of the first and second paperboard layer in the foldable second part are adapted to fold into a self-supporting pedestal structure configured to project away from the nonfoldable first part and operable to be seated in the cylindrical shape-supporting cavity and restrict lateral movement of the food container relative to the receptacle.

9. The packaged food product of claim 8, wherein the foldable second part further comprises:

a second fold line in the first paperboard layer generally parallel to and separated by an intervening first distance from the first fold line, and parallel cut lines extending generally perpendicularly between the first and second fold lines, to define a first foldable portion of the foldable second part;

a third fold line in the second paperboard layer generally parallel to and separated by an intervening second distance from the first fold line, and parallel cut lines extending generally perpendicularly between the third and first fold lines, to define a base portion of the foldable second part, and wherein the second distance is greater than the first distance;

a fourth fold line in the second paperboard layer generally parallel to and separated by an intervening third distance from the first fold line, parallel cut lines extending generally perpendicularly between the fourth and first fold lines, and wherein the third distance is greater than the second distance, to define a second foldable portion of the foldable second part located between the fourth and third fold lines, and wherein the first and third distances are approximately the same, and wherein the first and second foldable portions being foldable to substantially upright positions relative to the second paperboard layer such that first and second foldable portions and the intervening base portion form a self-supporting pedestal structure configured to project away from the nonfoldable first part and operable to be seated in the cylindrical shape-supporting cavity and restrict lateral movement of the food container relative to the receptacle.

10. The packaged food product of claim 8, wherein the second foldable portion further comprises a cutout operable to facilitate manual lifting of the second foldable portion away from the nonfoldable first part to form the pedestal structure.

11. The packaged food product of claim 1, wherein the second part comprises:

a first flap portion connected to the first part via a fold line provided in the paperboard such that the first flap portion is adapted to be foldable from an orientation generally coplanar with the first part into a downwardly-extending position oriented substantially perpendicular to the first part, a second flap portion having an arch-shaped structure comprising first and second arms merging with the first part at respective fold lines and a bridge portion connecting the arms, wherein the second flap portion is adapted to be folded from an orientation generally coplanar with the first part to a folded position located over the first flap portion in sliding engagement therewith such that the second flap portion is foldable into a downwardly-extending position wherein its arms are oriented substantially perpendicular to the first part and its bridge portion is oriented substantially perpendicular to the folded first flap portion, and wherein the folded first and second flap portions are adapted to form a self-supporting pedestal structure configured to project away from the second side of the first part and operable to be seated in the cylindrical shape-supporting cavity and restrict lateral movement of the food container relative to the receptacle.

12. The packaged food product of claim 11, wherein the second flap has a tapered lower end and is shaped and dimensioned to be fitted into and stably retained by a holder capable of receiving and holding a cylindrical beverage container.

13. A container support system comprising:

a beverage container receptacle including a planar support surface, the support surface including a cylindrical shape-supporting cavity disposed therein which is defined by a sidewall operable to provide lateral support to a cylindrical beverage container;

a non-cylindrical, multi-sided food container containing a food product, and an adapter integrally attached to a bottom side of the food container, wherein the adapter comprises a flat first part attachable to a bottom of a food container and a second part foldable into a self-supporting pedestal structure configured to project away from the first part and being operable to be seated in the cylindrical shape-supporting cavity of the beverage container receptacle and restrict lateral movement of the food container attached thereto relative to the receptacle.

14. The container support system of claim 13, wherein the pedestal structure has a diameter allowing it to be inserted into the cylindrical shape-supporting cavity of the beverage container receptacle.

* * * * *